US006604802B2

(12) United States Patent
Horio et al.

(10) Patent No.: US 6,604,802 B2
(45) Date of Patent: Aug. 12, 2003

(54) INKJET HEAD AND INKJET RECORDING APPARATUS

(75) Inventors: Hideaki Horio, Fukuoka (JP); Koji Matsuo, Fukuoka (JP); Haruyuki Hatano, Kumamoto (JP); Yutaka Miyazono, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/877,109

(22) Filed: Jun. 11, 2001

(65) Prior Publication Data

US 2002/0005871 A1 Jan. 17, 2002

(30) Foreign Application Priority Data

Jun. 20, 2000 (JP) ..... 2000-184007

(51) Int. Cl.[7] ..... B41J 29/38
(52) U.S. Cl. ..... 347/11; 347/10
(58) Field of Search ..... 347/11

(56) References Cited

U.S. PATENT DOCUMENTS 5,359,358 A * 10/1994 Shimamura et al. ..... 347/9
5,757,391 A * 5/1998 Hoisington ..... 347/11
6,109,716 A * 8/2000 Takahashi ..... 347/11
6,126,259 A * 10/2000 Stango et al. ..... 347/9
6,328,395 B1 * 12/2001 Kitahara et al. ..... 347/9

FOREIGN PATENT DOCUMENTS

JP 5-238008 9/1998 ..... B41J/2/045

* cited by examiner

*Primary Examiner*—Hai Pham
*Assistant Examiner*—Alfred Dudding
(74) *Attorney, Agent, or Firm*—Wenderoth, Lind & Ponack, L.L.P.

(57) ABSTRACT

An inkjet recording apparatus includes a moving device which moves an inkjet head relative to a recording medium. When the head is moved relative to the recording medium by the moving device, a nozzle of the head ejects ink onto the recording medium, so that recording is carried out. The inkjet head includes (a) pressure chambers containing ink, (b) nozzles communicating through the pressure chambers, (c) piezoelectric elements, (d) piezoelectric actuators that deform to increase or decrease the capacities of the pressure chambers due to piezoelectric effect of the piezoelectric elements, and (e) a controller for driving the actuators at a frequency not less than 20 kHz. This structure allows the actuators to operate substantially noiseless, and an image can be recorded at higher speed.

31 Claims, 8 Drawing Sheets

T1≦Tu≦T2
Tu
P3

S7
S9
S8
Displacement

Time
T1
T2

INKJET HEAD AND INKJET RECORDING APPARATUS

FIELD OF THE INVENTION

The present invention relates to an inkjet head and an inkjet recording apparatus. More particularly, it relates to the inkjet head with low noise and high speed at recording operation due to driving an actuator—ejecting ink—at a frequency not less than 20 kHz. The present invention also relates to the inkjet recording apparatus using this inkjet head.

BACKGROUND OF THE INVENTION

An inkjet head of a conventional inkjet recording apparatus ejects ink by piezoelectric effect of a piezoelectric element. This kind of head comprises, in general, the following elements:

(a) a head body formed by a plurality of pressure chambers containing ink and a plurality of nozzles communicating through each chamber;

(b) a piezoelectric actuator for ejecting ink from the nozzle by deforming itself so that a capacity of each pressure chamber increases/decreases; and (c) a control circuit for supplying a drive signal to the actuator.

When the actuator is driven, sound pressure occurs upon its deformation, and thus an operator hears a harsh driving noise of the actuator.

In particular, recently, an inkjet recording apparatus has been expected to produce a quality picture at high speed, and thus when a number of nozzles is increased in order to upgrade picture quality, numbers of piezoelectric actuators are prepared. Thus the operator hears louder driving noise. On the other hand, when a driving frequency of the piezoelectric actuator is increased in order to gain a recording speed, driving noise of a rather high frequency occurs. This noise sounds extremely harsh to the users.

When a dc motor with less noise is used as a driver for moving the head and recording medium in order to reduce the moving noise of the apparatus, the driving noise of the actuator sounds relatively louder, and it sounds harsher to the users.

Japanese patent application non-examined publication No. H05-238008 discloses a countermeasure against the problem discussed above, i.e., a piezoelectric actuator for ejecting ink is provided to a pressure chamber containing ink, and another piezoelectric actuator for a non-ejecting purpose is provided to a pressure chamber which does not contain ink. Thus the inkjet head as a whole is driven at 16 kHz, which is out of audible range, by driving these actuators alternately. In this case, however, the actuator for a non-ejecting purpose must be prepared only for obtaining a driving frequency of 16 kHz, and this actuator is not needed regularly.

In the inkjet head disclosed in the above publication, a number of vibrations of vibration system proper to each actuator differs from each other due to processing accuracy of, e.g., the pressure chambers and actuators. Therefore, when both the actuators are respectively driven, different sound pressures occur alternately, which sounds rather louder to the users in spite of the original purpose, i.e., lowering the noise.

SUMMARY OF THE INVENTION

The present invention addresses the problems discussed above, and aims to provide an inkjet head as well as an inkjet recording apparatus which can lower the noise and record at high speed. The inkjet head of the present invention comprises the following elements:

(a) at least one pressure chamber containing ink;

(b) a nozzle communicating through the pressure chamber;

(c) at least one piezoelectric actuator having a piezoelectric element and deforming itself by piezoelectric effect of the piezoelectric element so that the capacity of the pressure chamber increases or decreases; and (d) a controller for driving the piezoelectric actuator at a frequency not less than 20 kHz and for controlling the ink in the pressure chamber to be ejected from the nozzle at a desired timing.

This structure allows the controller to drive the piezoelectric actuator at the frequency not less than 20 kHz, so that the driving noise of the actuator is out of audible range and the user hardly hear this noise. This structure differs from the inkjet head disclosed in the publication discussed previously and can drive the actuator with less driving noise without the actuator for the non-ejecting purpose. In this structure, since one actuator is driven at the frequency not less than 20 kHz, the same sound pressure occurs positively at not less than 20 kHz compared with a case where two types of actuators are alternately driven. As a result, driving noise becomes surely smaller.

The inkjet recording apparatus of the present invention comprises the following elements:

(a) the inkjet head discussed above; and (b) a moving device for moving the head relative to a recording medium, and while the head is moved relative to the recording medium by the moving device, a nozzle ejects ink onto the recording medium to carry out the recording. This structure allows the apparatus to provide the same advantage as discussed above.

Another inkjet recording apparatus of the present invention comprises the following elements:

(a) at least one inkjet head including:

(a-1) at least one pressure chamber containing ink;

(a-2) at least one nozzle for communicating through the pressure chamber;

(a-3) at least one actuator for increasing the pressure of the pressure chamber; and (a-4) a controller for driving the piezoelectric actuator at a frequency not less than 20 kHz and for controlling the ink in the pressure chamber to be ejected from the nozzle at a desired timing;

(b) a first dc motor for moving a carriage, to which the head is mounted, in a main scanning direction; and (c) a second dc motor for moving a recording medium in a sub-scanning direction.

This structure allows the apparatus to reduce the operation noise by using the dc motors instead of stepping motors for moving the carriage and the recording medium. Further, because the driving noise of the head makes little sound, the apparatus as a whole can be expected to undergo substantially noiseless operation.

DETAILED DESCRIPTION OF EXEMPLARY EMBODIMENTS

The exemplary embodiments of the present invention are demonstrated hereinafter with reference to the accompanying drawings.

First Exemplary Embodiment

Figure 1:
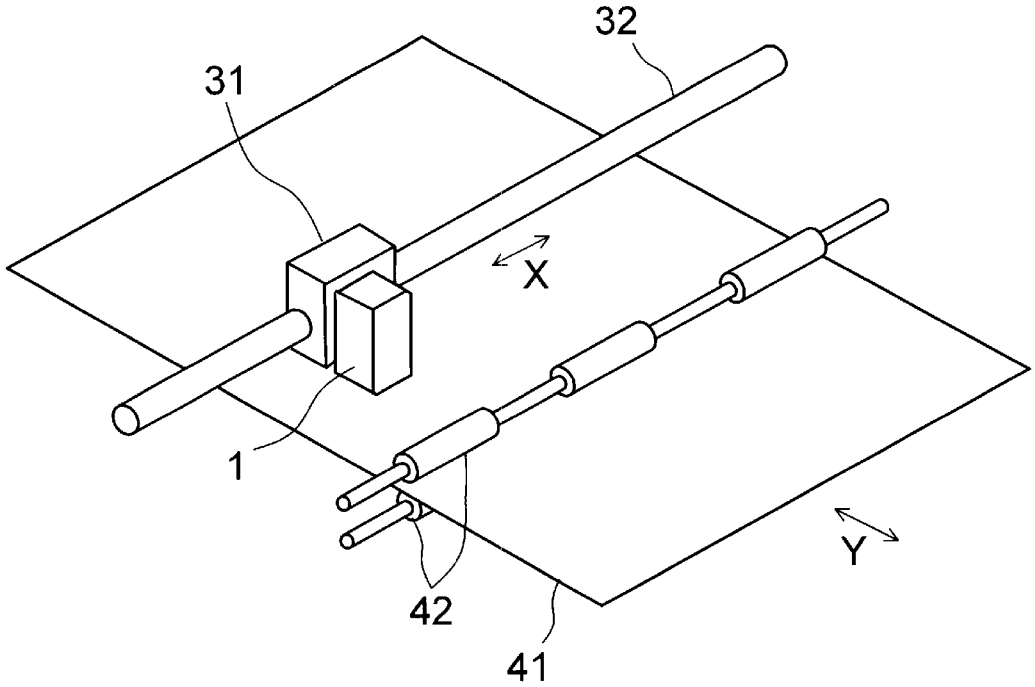
FIG. 1 shows a schematic structure of an inkjet recording apparatus in accordance with a first exemplary embodiment of the present invention.

FIG. 1 shows a schematic structure of an inkjet recording apparatus in accordance with the first exemplary embodiment of the present invention. In FIG. 1, the apparatus includes an inkjet head 1 for ejecting ink onto a sheet of recording paper 41 as a recording medium. Head 1 is rigidly mounted to carriage 31, which is guided by carriage shaft 32 extending in a main scanning direction, i.e., an X direction shown in FIG. 1. Carriage 31 is reciprocated in the main scanning direction by carriage motor 78 (first motor; not shown in FIG. 1, but shown in FIG. 5).

Figure 5:
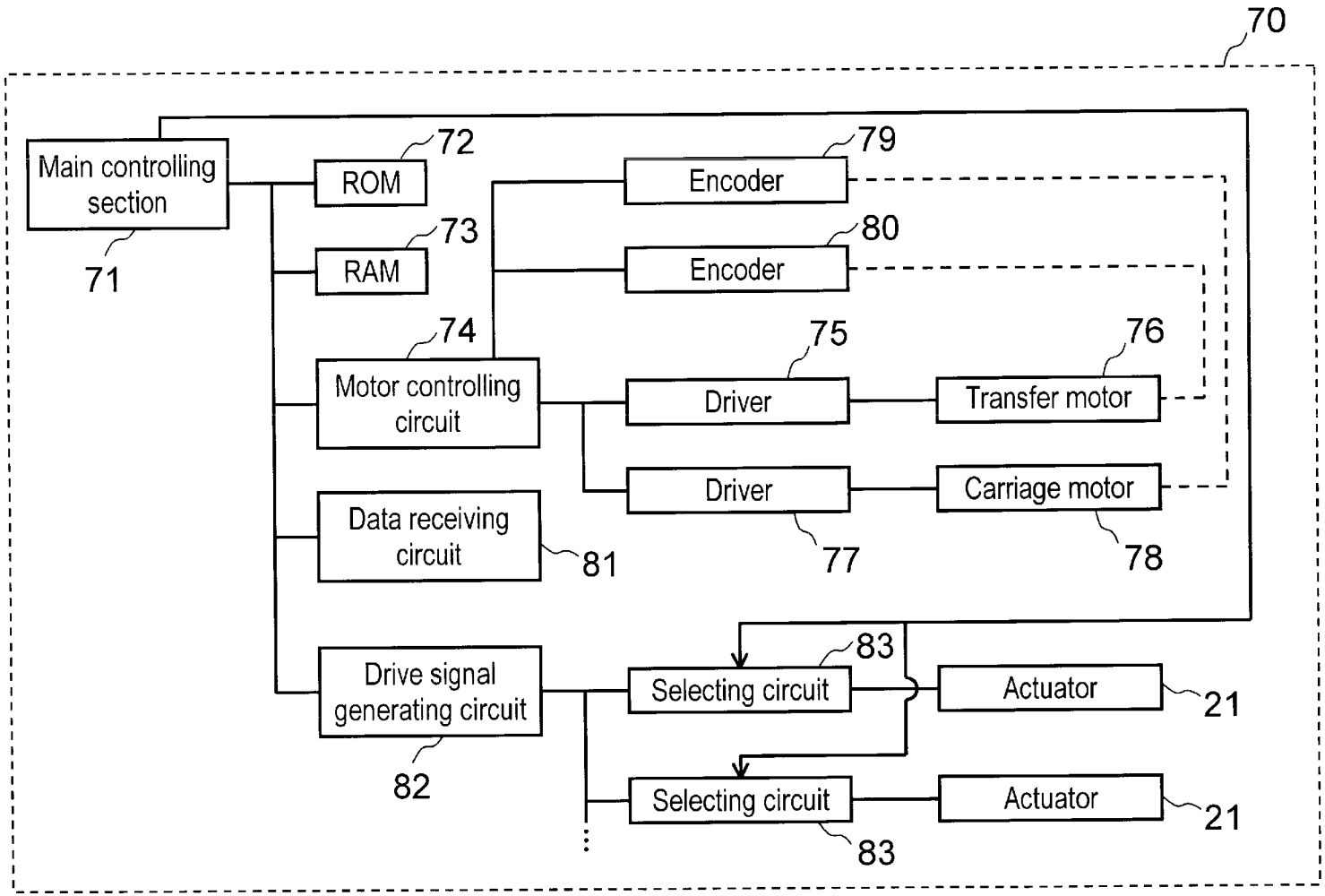
FIG. 5 shows a circuit in a block diagram of a controller of the apparatus shown in FIG. 1.

Paper 41 is pinched by two transfer rollers 42 driven by transfer motor 76 (second motor; not shown in FIG. 1, but shown in FIG. 5). Paper 41 is transferred under head 1 and in a sub-scanning direction, i.e., a Y direction shown in FIG. 1, by motor 76 and the pair of rollers 42.

A moving device is thus structured by carriage 31, shaft 32, motor 76, motor 78 and the pair of rollers 42, and moves head 1 relative to paper 41. Motors 76 and 78 are both dc motors.

Figure 2:
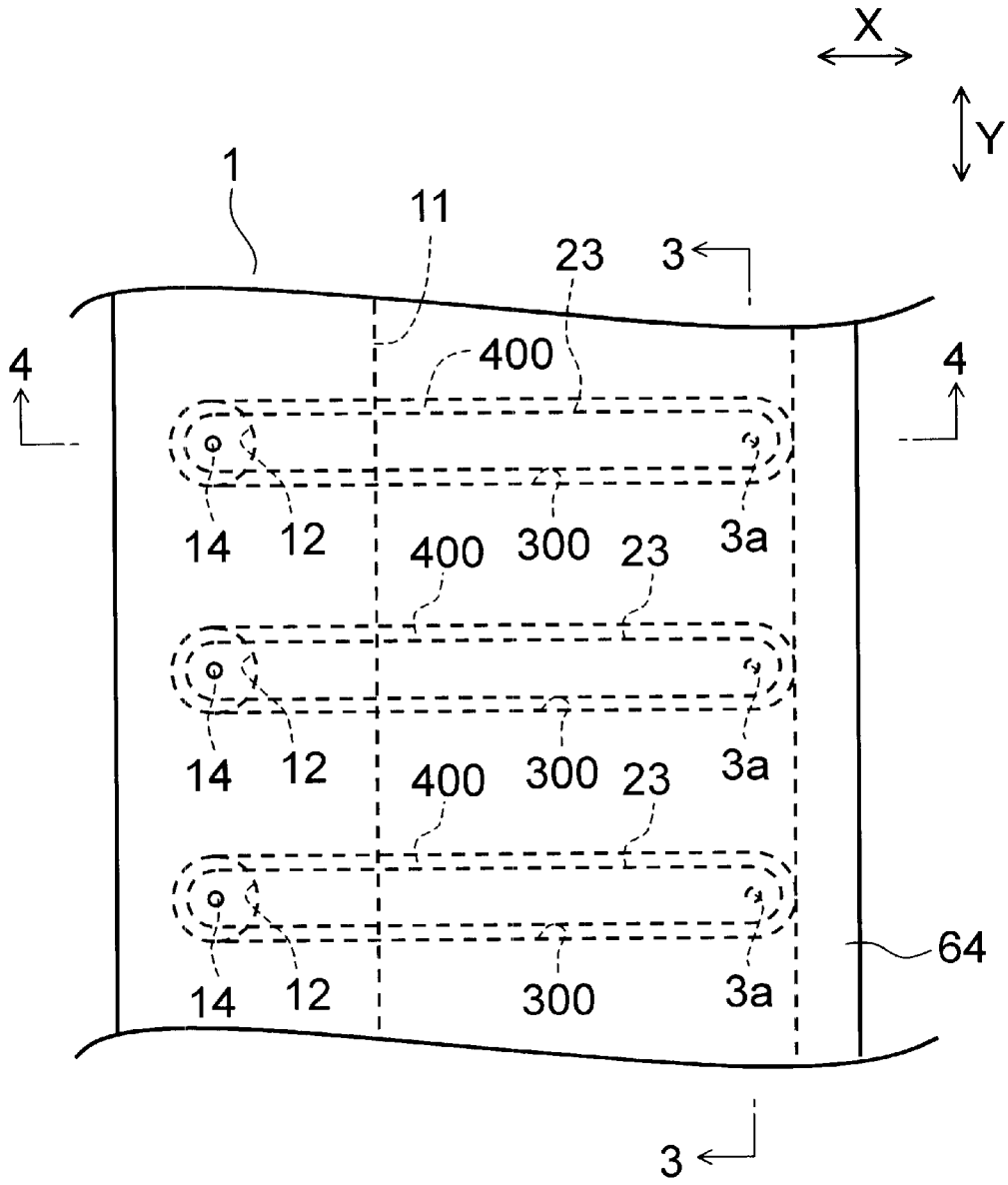
FIG. 2 shows a partial bottom view of an inkjet head of the apparatus shown in FIG. 1.
Figure 3:
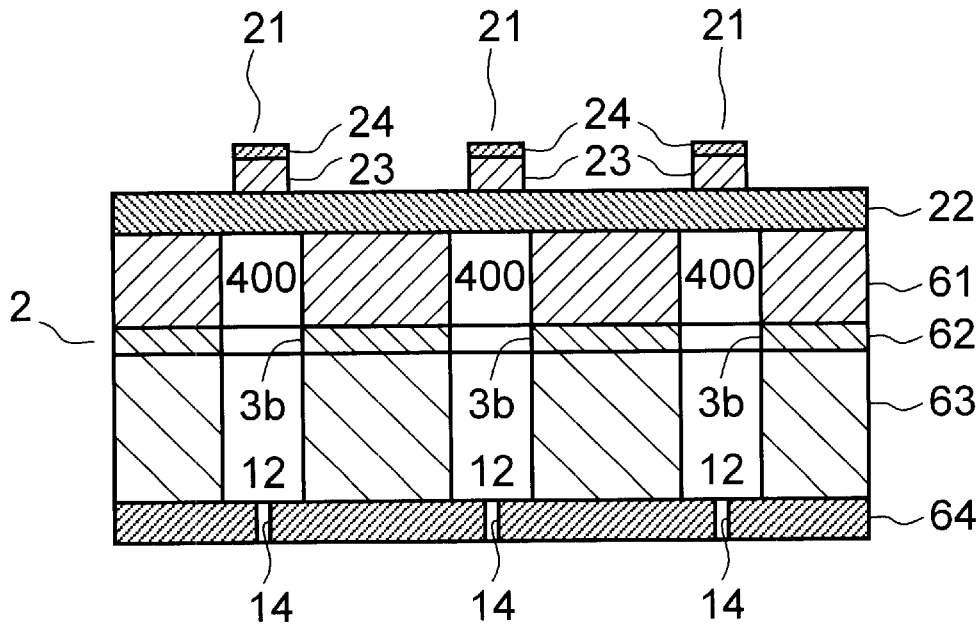
FIG. 3 is a cross section taken along line 3—3 of FIG. 2.
Figure 4:
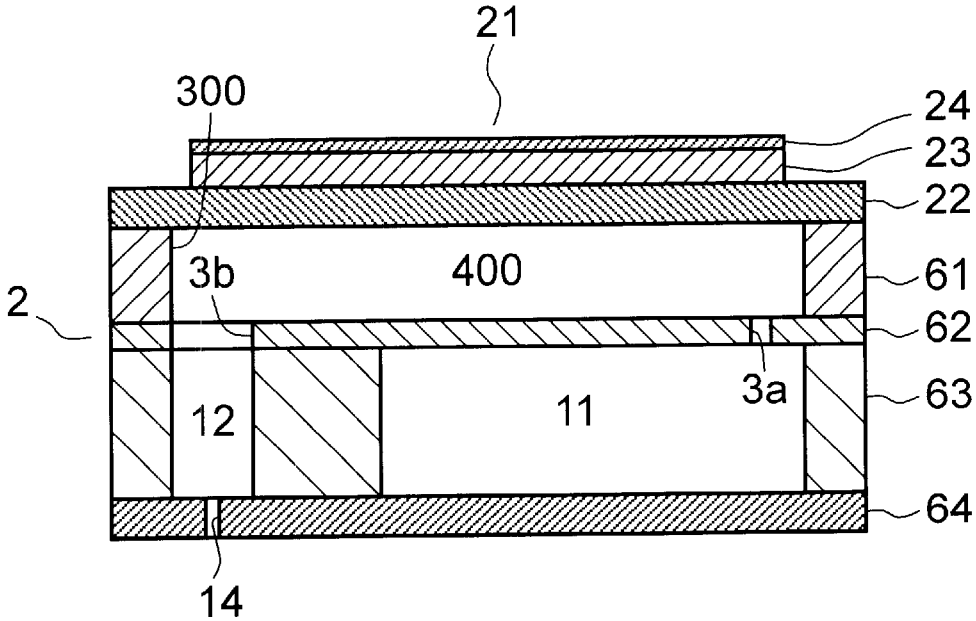
FIG. 4 is a cross section taken along line 4—4 of FIG. 2.

FIG. 2 shows a partial bottom view of the inkjet head of the apparatus shown in FIG. 1. FIG. 3 is a cross section taken along line 3—3 of FIG. 2, and FIG. 4 is a cross section taken along line 4—4 of FIG. 2.

In head body 2, recesses 300 are formed for constructing a plurality of pressure chambers. As shown in FIG. 2 through FIG. 4, each recess 300 has supply-inlet 3*a* for supplying ink and eject-outlet 3*b* for ejecting the ink.

Each recess 300 on head body 2 extends along and opens toward the main scanning direction (X direction shown in FIG. 2). Respective recesses 300 are arranged in the sub-scanning-direction (Y direction shown in FIG. 2) at approx. equal intervals. The opening rim of each recess 300 forms an approx. semicircle.

The side-wall of each recess 300 is formed by first board 61 of photo-sensitive glass having approx. 200 $\mu$m thickness. The bottom plate of each recess 300 is formed by second board 62 bonded beneath first board 61. Board 62 is made of stainless steel having approx. 30 $\mu$m thickness, and supply-inlet 3*a* and eject-outlet 3*b* are formed thereon.

Beneath board 62, third board 63 made of stainless steel having approx. 300 $\mu$m thickness is bonded. On board 63, one supplying-ink-flow-path 11 extending in Y direction and communicating to supply-inlets 3*a* of respective recesses 300 is formed, and a plurality of ejecting-ink-flow-paths 12 communicating to respective eject-outlets 3*b* are also formed. Flow-path 11 is coupled to an ink tank not shown in the drawings. This tank supplies the ink into flow-path 11.

Beneath board 63, fourth board 64—forming a lower face of head 1 is bonded. Board 64 is made of stainless steel having approx. 70 $\mu$m thickness and has a plurality of nozzles 14 for ejecting the ink to paper 41. Nozzles 14 are approx. 20 $\mu$m across. Nozzles 14 are coupled to respective flow-paths 12, and via flow-paths 12, nozzles 14 are coupled to eject-outlets 3*b* of recesses 300. Respective nozzles 14 are arranged along a line in the Y direction beneath head 1.

On each recess 300, piezoelectric actuator 21 is provided. Each actuator 21 comprises diaphragm 22 made of chrome (Cr), piezoelectric element 23 (piezoelectric constant= approx. $8\times10^{-11}$ m/V) made of lead zirconium titanate (PZT), and individual electrode 24 made of platinum (Pt) having 0.1 $\mu$m thickness.

Diaphragm 22 is bonded on the upper face of head body 2 and stops up recesses 300, so that it forms pressure chambers 400 together with recesses 300. Diaphragm 22 is commonly shared by all actuators 21 and functions as an electrode common to every piezoelectric element 23.

Each piezoelectric element 23 on the upper face of diaphragm 22 (on the face opposite to pressure chamber 400 with respect to diaphragm 22) is bonded to the area corresponding to pressure chamber 400 (the area facing the opening of recess 300 via diaphragm 22).

Each electrode 24 is bonded to the upper face of each piezoelectric element 23 (the face opposite to diaphragm 22 with respect to each piezoelectric element). A voltage (a drive signal) for driving each piezoelectric element 23 is applied between each electrode 24 and diaphragm 22 (common electrode).

At approx. a center of the width of the opening of recess 300, respective piezoelectric elements 23 are laid on respective electrodes 24 and extend in the same direction as the opening of recess 300 (X direction). The lengths of element 23 and electrode 24 are slightly shorter than the opening width of recess 300, and both the ends form approx. semicircles the same as both the ends of the opening of recess 300. Each diaphragm 22, piezoelectric element 23 and electrode 24 are formed of a thin film by a spattering method.

The actuators 21 apply drive signals to piezoelectric elements 23, respectively, via diaphragm 22 (common electrode) and individual electrodes 24, so that the portions (the openings of recesses 300) of diaphragm 22 corresponding to pressure chambers 400 are deformed. This deformation ejects the ink in each pressure chamber 400 from nozzle 14 through eject-outlet 3*b* and flow-path 12.

The structure discussed above allows each piezoelectric actuator 21 to be driven at the maximum frequency not less than 20 kHz.

Next, a structure of the controller of the inkjet recording apparatus is described with reference to the block diagram shown in FIG. 5. Controlling section 70 comprises the following elements:

(a) main controlling section 71 including a CPU;

(b) ROM 72 storing a routine and the like for processing various data;

(c) RAM 73 for storing various data;

(d) driver circuit 75 for driving transfer motor 76;

(e) driver circuit 77 for driving carriage motor 78;

(f) encoder 80 for coding an operation of motor 76;

(g) encoder 79 for coding an operation of motor 78;

(h) motor controlling circuit 74 for controlling respective motors using the signals from respective encoders;

(i) data receiving circuit 81 for receiving printed data;

(j) drive-signal-generating-circuit 82 for generating a drive signal; and (k) a plurality of selecting circuits 83 to which respective piezoelectric actuators are coupled.

The selecting circuit 83 receives a drive signal from circuit 82 while head 1 moves in the main scanning direction (X direction), and outputs the drive signal selectively to actuator 21. Circuits 82 and 83 from a controller which controls the drive of actuator 21.

Figure 6A:
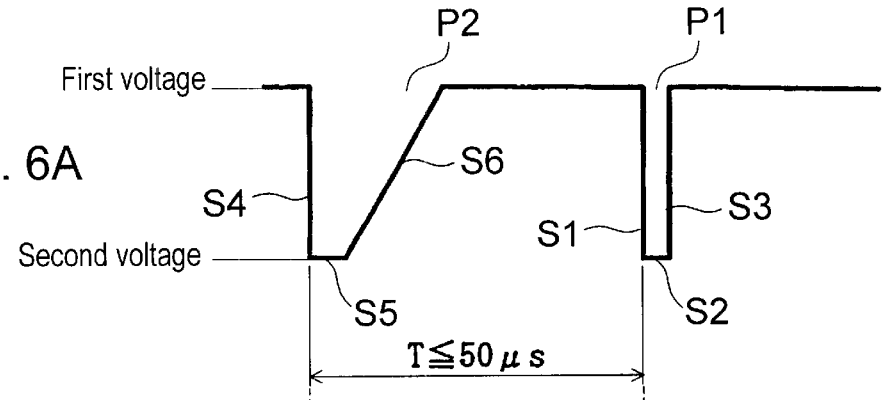
FIG. 6A shows waveforms of signals driving a piezoelectric actuator of the apparatus shown in FIG. 1.
Figure 6B:
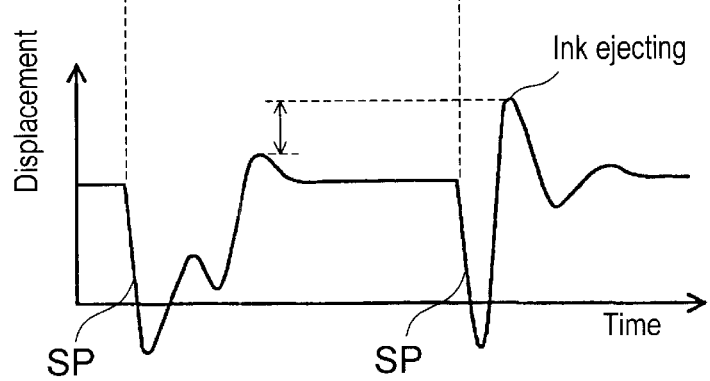
FIG. 6B shows displacement curves of the piezoelectric actuator by the drive signals shown in FIG. 6A.

Driving operation of the actuator is demonstrated with reference to FIGS. 6A and 6B. FIG. 6A shows waveforms of signals driving a piezoelectric actuator of the apparatus shown in FIG. 1. FIG. 6B shows displacement curves of the piezoelectric actuator by the drive signals shown in FIG. 6A.

A drive signal in accordance with the first embodiment includes two types of signals. One is ink-ejecting-signal P1 for driving actuator 21 so that ink is ejected from nozzle 14, and the other is ink-non-ejecting-signal P2 for driving actuator 21 so that the ink is prevented from ejecting from nozzle 14.

Ink-ejecting-signal P1 is formed by a first waveform, i.e., voltage-lowering-waveform S1, a second waveform, i.e., voltage-rising-waveform S3, and a third waveform, i.e., voltage-holding-waveform S2. Waveform S1 lowers from a given first voltage to a given second voltage and deforms actuator 21 so that pressure chamber 400 is decompressed (capacity of chamber 400 increases). Waveform S3 rises from the second given voltage to the first given voltage. Waveform S2 holds the second given voltage between waveforms S1 and S3. Signal P1 structured as discussed above has a waveform producing a so-called push-pull action.

In this first embodiment, the voltage lowers from the first voltage to the second voltage (first voltage>second voltage), and thereby actuator 21 deforms to increase the capacity of pressure chamber 400. However, when polarization of piezoelectric element 23 in actuator 21 is reversed, the voltage rises from the first one to the second one (first voltage<second voltage), and thereby actuator 21 deforms to increase the capacity of pressure chamber 400.

On the other hand, ink-non-ejecting signal P2 is formed by a first waveform, i.e., voltage-lowering-waveform S4, a second waveform, i.e., voltage-rising-waveform S6, and a third waveform between S4 and S6, i.e., voltage-holding-waveform S5. Waveform S4 draws approx. the same form as waveform S1 of signal P1, and lowers from the first voltage to the second voltage. Waveform S5 holds the second voltage. Waveform S6 differs from waveform S3 of signal P1, and the voltage rises moderately from the second voltage to the first one.

Figure 7:
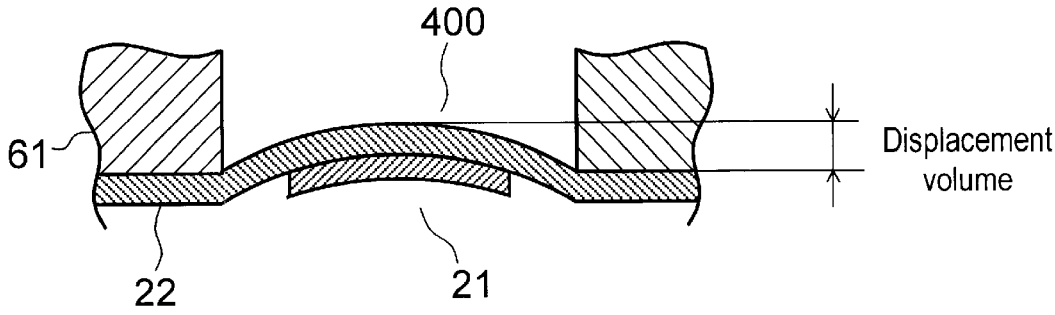
FIG. 7 shows deformation of the piezoelectric actuator by the drive signal shown in FIG. 6A.

The deformation of the actuator due to receiving signals P1 and P2 is described with reference to FIG. 6B. Displacement of actuator 21 shown in FIG. 7 is a displacement at the width center of the actuator. Head 1 shown in FIG. 7 is disposed upside down from that shown in FIGS. 3 and 4. In FIG. 6B, the displacement of actuator 21 contributing to reducing the capacity of pressure chamber 400 is taken as positive displacement.

First, ink-ejecting-signal P1 is supplied to actuator 21, and then actuator 21 is deformed by waveforms S1 and S2 to increase the capacity of pressure chamber 400 (decompressing chamber 400); in other words, actuator 21 performs a so-called "pull action." At this moment, sound pressure occurs (refer to "SP" in FIG. 6B). This "pull action" introduces ink from ink-supply-inlet 3*a* to pressure chamber 400. After this, actuator 21 is sharply deformed by waveform S3 to reduce the capacity of pressure chamber 400, so as to compress the ink in chamber 400. In other words, actuator 21 performs the so called "push action", and thereby nozzle 14 ejects the ink.

On the other hand, when ink-non-ejecting signal P2 is supplied to actuator 21, actuator 21 is deformed by waveforms S4 and S5 to increase the capacity of pressure chamber 400. The sound pressure also occurs at this time (refer to "SP" in FIG. 6B). After this, actuator 21 is deformed by waveform S6 to decrease the capacity of chamber 400. However, since waveform S6 rises moderately, the pressure applied to the ink varies also moderately, and yet, the maximum displacement of actuator 21 is smaller than the case when signal P1 is supplied (refer to the arrow mark shown in FIG. 6B). Therefore, the ink does not eject from nozzle 14 due to surface tension on the opening of nozzle 14.

Next, an operation of the inkjet recording apparatus is demonstrated. In FIG. 5, main controlling section 71 carries out the following control based on a process-routine stored in ROM 72 when data receiving circuit 81 receives image data: Motor control circuit 74 controls transfer motor 76 with driver circuit 75 and encoder 80. Control circuit 74 controls carriage motor 78 with driver circuit 77 and encoder 79. Drive signal generating circuit 82 generates drive signals, i.e., ink-ejecting signal P1 and ink-non-ejecting signal P2. Further, based on the image data, main controlling section 71 outputs the information about ink ejection to respective selecting circuits 83. Receiving the information, respective selecting circuits 83 supply signal P1 to respective actuators 21 at the timing when the ink is ejected, while circuits 83 discontinue signal P1 at the timing when the ink is not ejected.

Even in the timing when the ink is not ejected, but at the specific timing when actuator 21 must be driven for making the driving frequency of respective actuators not less than 20 kHz, ink-non-ejecting signal P2 is supplied to actuator 21. Therefore, when ink-ejecting signal P1 is supplied at not less than 20 kHz (supply cycle of signal P1 is not more than 50 μsec.), only signal P1 is supplied to actuator 21. On the other hand, when signal P1 is supplied at less than 20 kHz (supply cycle is more than 50 μsec.), ink-non-ejecting signal P2 is supplied between present signal P1 and coming signal P1, so that time T between signal P1 and signal P2 becomes not more than 50 μsec. As such, respective actuators 21 are always driven at not less than 20 kHz, and the ink arrives at a given point on recording paper 41, thereby forming a desirable image.

As discussed above, in the first embodiment, respective piezoelectric actuators 21 are driven at a frequency not less than 20 kHz, i.e., out of audible range. Thus the frequency of sound pressure generated by deformation of actuator 21 is not less than 20 kHz. As a result, the users hardly hear the driving noise of the actuators, and inkjet head 1 operates silently. At this time, since two types of signals, i.e., ink-ejecting signal P1 and ink-non-ejecting signal P2, are supplied to actuator 21, a desirable image can be formed on recording paper 41 while actuator 21 is driven at a frequency not less than 20 kHz.

To respective actuators 21, signal P1 or signal P2 is supplied, so that actuators 21 are driven at the driving frequency not less than 20 kHz. Further, because waveform S4 of signal P2 draws approx. the same form as waveform S1 of signal P1, whichever signal P1 or P2 is supplied, actuator 21 deforms at the same deforming speed and by the same displacement, and produces the same sound pressure (refer to FIG. 6B). Therefore, the driving noise positively becomes not less than 20 kHz and is free from affects of processing accuracy of respective actuators 21.

Further, if numbers of actuators 21 are employed, each actuator 21 is driven at the frequency not less than 20 kHz, and the driving noise sounds silent. Thus the inkjet head realizing a quality picture and noiseless operation is obtainable. In addition, since each actuator 21 is driven at a high frequency, an image can be recorded at higher speed. On top of that, because ink-non-ejecting signal P2 is supplied, actuator 21 is driven to deform itself, thereby preventing the ink in chamber 400 from drying out when the ink is not ejected but stays still. As a result, the apparatus can maintain excellent ink-ejecting performance.

Carriage motor 78 and transfer motor 76 employ dc motors instead of conventional stepping motors, thereby lowering the operation noise, and yet, the driving noise of inkjet-head 1 sounds silent as discussed above. These two factors result in substantially noiseless operation of the inkjet recording apparatus as a whole.

Second Exemplary Embodiment

Figure 8A:
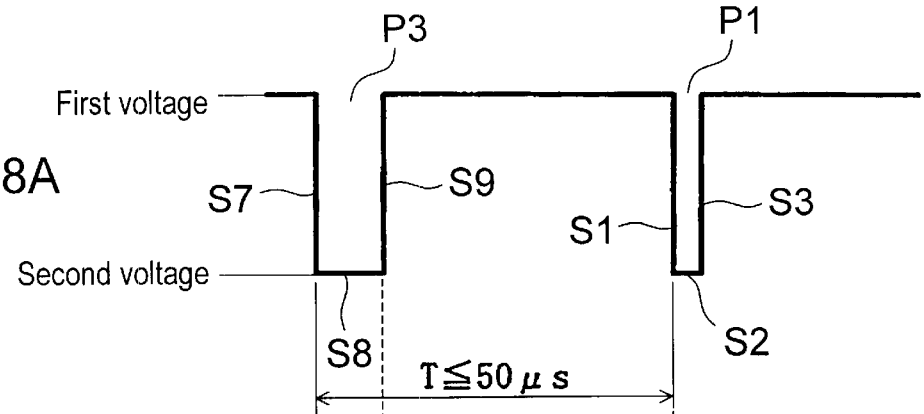
FIG. 8A shows waveforms of signals driving a piezoelectric actuator in accordance with a second exemplary embodiment of the present invention.
Figure 8B:
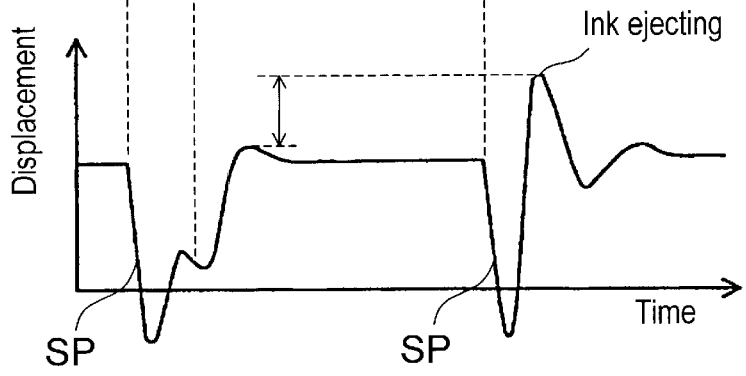
FIG. 8B shows displacement curves of the piezoelectric actuator by the drive signals shown in FIG. 8A.
Figures 9A, 9B, 9C:
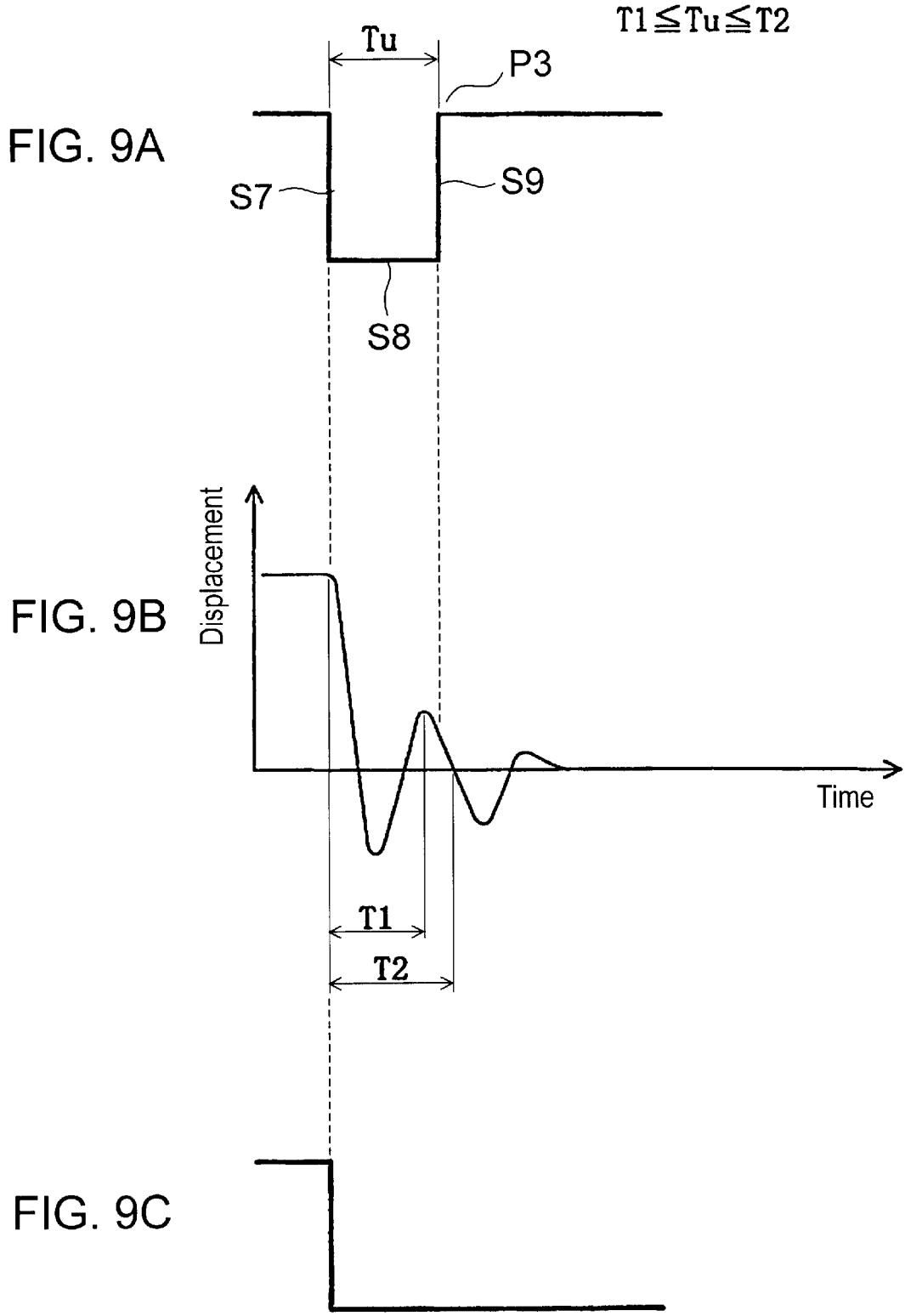
FIG. 9A shows a waveform of an ink-non-ejecting signal of the drive signal shown in FIG. 8A.
FIG. 9B shows a displacement curve of the piezoelectric actuator by the ink-non-ejecting signal shown in FIG. 9A.
FIG. 9C is a waveform showing a voltage drop by the ink-non-ejecting signal shown in FIG. 9A.

FIG. 8A shows a waveform of a signal which drives a piezoelectric actuator in accordance with the second exemplary embodiment of the present invention. FIG. 8B shows displacement curves of the piezoelectric actuator by the drive signals shown in FIG. 8A. FIG. 9A shows a waveform of an ink-non-ejecting signal in the drive signal shown in FIG. 8A. FIG. 9B shows a displacement curve of the piezoelectric actuator by the ink-non-ejecting signal shown in FIG. 9A. FIG. 9C is a waveform showing a voltage drop by the ink-non-ejecting signal shown in FIG. 9A.

The second embodiment differs from the first one in the following point: The waveform of ink-non-ejecting signal P3 is different from ink-non-ejecting signal P2 in the first embodiment. Meanwhile an inkjet head and an inkjet recording apparatus have the same structures as those of the first embodiment, thus the descriptions thereof are omitted here.

As shown in FIG. 8A, signal P3 is formed by (a) voltage lowering waveform S7 lowering from a first voltage to a second voltage, (b) voltage rising waveform S9 rising from the second voltage to the first voltage, and (c) voltage holding waveform S8 holding the second voltage between waveforms S7 and S9. This structure of signal P3 is the same as that of signal P2 in the first embodiment. However, voltage rising waveform S9 draws a different waveform from waveform S6 in the first embodiment. In other words, waveform S9 sharply rises like a step, while waveform S6 in the first embodiment moderately rises. Waveform S9 in the second embodiment is thus the same as voltage rising waveform S3 of ink-ejecting signal P1 in the first embodiment.

Voltage holding waveform S8 of signal P3 lasts longer than the counter-part S2 of signal P1 (duration time is longer). As shown in FIG. 9A, the duration time Tu of waveform S8 is set responsive to vibrations proper to the vibration system of piezoelectric actuator 21 (the vibration system includes influence of the ink in pressure chamber 400).

Duration time Tu of waveform S8 is to be adjusted responsive to the vibrations proper to the vibration system of actuator 21. For instance, when a pulse of rectangular waveform is input to actuator 21 so that the capacity of the pressure chamber increases, duration time Tu can be adjusted based on a transient response of actuator 21.

To be more specific, when a pulse voltage of rectangular waveform (voltage lowering waveform S7 of signal P3) as shown in FIG. 9C is applied to actuator 21, actuator 21 responds as shown in FIG. 9B. Duration time Tu can be determined as follows: in the response-waveform of actuator 21, actuator 21 deforms to increase the capacity of pressure chamber 400, then deforms to decrease the capacity, and again starts deforming to increase the capacity. Count this start time as T=T1. After T=T1, when a deforming speed to increase the capacity becomes maximum, count the time as T=T2. Duration time Tu is set between T1 and T2, i.e., $T1 \leqq Tu \leqq T2$. After T=T1, when actuator 21 deforms to increase the capacity, voltage rising waveform S9—deforming actuator 21 to decrease the capacity—is input, so that the vibration of actuator 21 is effectively damped. When signal P3 discussed above is supplied to actuator 21, the maximum displacement becomes smaller (refer to an arrow mark in FIG. 8B) and voltage variation of the ink in chamber 400 becomes smaller. As a result, the ink is not ejected from nozzle 14.

Ink-non-ejecting signal P3, as discussed above, in accordance with the second embodiment is formed by the same components as ink-ejecting signal P1 except the duration time of waveform S2. The duration time of S2 is changed in signal P3. In other words, signal P3 is formed by the waveforms having only the first voltage and the second voltage. This is the same construction as signal P1. As a result, drive-signal-generating-circuit 82 is structured simpler and less expensive than that in the first embodiment. Further, waveform S9 of signal P3 draws a step-like wave, thereby shortening a time required by signal P3. This allows each time of adjacent signals P1 and P3 to be shortened. Thus, the driving frequency of actuator 21 can be raised, thereby further gaining a recording speed.

The present invention is not limited to the first and second embodiments, but includes various modifications. In the first and second embodiments, even at the timing when the ink is not ejected, the actuator must be driven because of obtaining the driving frequency of the actuator at not less than 20 kHz, and at this timing, ink-non-ejecting signals P2 and P3 are supplied to actuator 21. However, the present invention is not limited to these embodiments. For instance, in the meantime between the timing of supplying the ink-ejecting-signal and the timing of supplying the next ink-ejecting-signal, the ink-non-ejecting-signal can be supplied without fail to the piezoelectric actuator. This structure allows the actuator to be driven at the frequency not less than 20 kHz, so that the inkjet head can operate substantially noiseless, and a desirable image can be formed.

When an image is not formed, the ink-non-ejecting signal at the frequency not less than 20 kHz is always supplied to the actuator. When an image is formed, the ink-ejecting signal is supplied to the actuator at a necessary timing in addition to this ink-non-ejecting signal. This structure also allows the inkjet head to operate substantially noiseless, and a desirable image can be formed.

Further, in the first and second embodiments, carriage motor 78 and transfer motor 76 employ dc motors; however, it is not limited to this structure. Either one of the motors can be a dc motor. The present invention also can be applied to a thermal type inkjet head or an electrostatic inkjet head instead of the inkjet head used in the first and second embodiments.

What is claimed is:

1. An inkjet head comprising:

(a) a pressure chamber for containing ink;

(b) a nozzle for communicating through said pressure chamber;

(c) a piezoelectric actuator having a piezoelectric element and deforming to increase or decrease a capacity of said pressure chamber due to piezoelectric effect of the piezoelectric element; and (d) a controller for driving said actuator by supplying signals including ink-ejecting signals for driving said actuator to eject the ink and ink-non-ejecting signals for driving said actuator not to eject the ink, so as to control ink in said chamber to be ejected from said nozzle at a desirable timing; and wherein said controller is operable to drive said actuator so that, when the desirable timing for ejecting ink is such that a frequency of said ink-ejecting signals is less than 20 kHz, ink-non-ejecting signals are supplied between ink-ejecting signals to cause an overall frequency of said signals to be not less than 20 kHz.

2. The inkjet head as defined in claim 1, wherein said controller is operable such that a time interval between said signals is not more than 50 $\mu$sec.

3. The inkjet head as defined in claim 1, wherein each of said ink-non-ejecting signals has a first waveform varying from a first voltage to a second voltage and which deforms said piezoelectric actuator to increase a capacity of said pressure chamber, a second waveform varying from the second voltage to the first voltage in a moderate manner and which deforms said actuator to decrease the capacity of said chamber moderately, and a third waveform holding the second voltage between the first and the second waveforms of each of the ink-non-ejecting signals.

4. The inkjet head defined in claim 3, wherein each of said ink-ejecting signals has a first waveform varying from the first voltage to the second voltage and which deforms said actuator to increase a capacity of said chamber, and a second waveform varying from the second voltage to the first voltage, and the first waveform of each of said ink-non-ejecting signals is approximately the same as the first waveform of each of said ink-ejecting signals.

5. The inkjet head as defined in claim 3, wherein the third waveform of each of said ink-non-ejecting signals differs from a third waveform of each of said ink-ejecting signals only in a duration time.

6. The inkjet head as defined in claim 3, wherein each of said ink-ejecting signals varies between said first voltage and said second voltage.

7. The inkjet head as defined in claim 3, wherein said controller is operable such that a time interval between said signals is not more than 50 $\mu$sec.

8. The inkjet head as defined in claim 1, wherein each of said ink-non-ejecting signals has a first waveform varying from a first voltage to a second voltage and which deforms said actuator to increase a capacity of said pressure chamber, a second waveform varying from the second voltage to the first voltage and which deforms said actuator to decrease the capacity of said chamber, and a third waveform holding the second voltage between the first and the second waveforms of the ink-ejecting signal; and wherein each of said ink-non-ejecting signals has a fourth waveform varying from said first voltage to said second voltage and which deforms said actuator to increase a capacity of said pressure chamber, a fifth waveform varying from the second voltage to the first voltage and which deforms said actuator to decrease the capacity of said chamber moderately and a sixth waveform holding the second voltage between the fourth and the fifth waveforms of the ink-non-ejecting signal.

9. The inkjet head as defined in claim 8, wherein the fourth waveform and the fifth waveform of each of said ink-non-eject signals are asymmetrical.

10. The inkjet head as defined in claim 8, wherein the fifth waveform varies from the second voltage to the first voltage in a moderate manner.

11. The inkjet head as defined in claim 8, wherein said controller is operable such that a time interval between said signals is not more than 50 $\mu$sec.

12. An inkjet recording apparatus comprising:

(a) an inkjet head including (a-1) a pressure chamber for containing ink, (a-2) a nozzle for communicating through said pressure chamber, (a-3) a piezoelectric actuator having a piezoelectric element and deforming to increase or decrease a capacity of said pressure chamber due to piezoelectric effect of the piezoelectric element, and (a-4) a controller for driving said actuator by supplying signals including ink-ejecting signals for driving said actuator to eject the ink and ink-non-ejecting signals for driving said actuator not to eject the ink, so as to control ink in said chamber to be ejected from said nozzle at a desirable timing; and (b) a moving device for moving said head relative to a recording medium, wherein when said head is moved relative to the recording medium by said moving device, said nozzle ejects ink to carry out recording on the recording medium;

wherein said controller is operable to drive said actuator so that, when the desirable timing for ejecting ink is such that a frequency of said ink-ejecting signals is less than 20 kHz, ink-non-ejecting signals are supplied between ink-ejecting signals to cause an overall frequency of said signals to be not less than 20 kHz.

13. The inkjet recording apparatus as defined in claim 12, wherein said moving device is driven by a dc motor.

14. The inkjet recording apparatus as defined in claim 12, wherein said controller is operable such that a time interval between said signals is not more than 50 $\mu$sec.

15. The inkjet recording apparatus as defined in claim 12, wherein each of said ink-non-ejecting signals has a first waveform varying from a first voltage to a second voltage and which deforms said piezoelectric actuator to increase a capacity of said pressure chamber, a second waveform varying from the second voltage to the first voltage in a moderate manner and which deforms said actuator to decrease the capacity of said chamber moderately, and a third waveform holding the second voltage between the first and the second waveforms of each of the ink-non-ejecting signals.

16. The inkjet recording apparatus as defined in claim 15, wherein each of said ink-ejecting signals varies between said first voltage and said second voltage.

17. The inkjet recording apparatus as defined in claim 15, wherein each of said ink-ejecting signals has a first waveform varying from the first voltage to the second voltage and which deforms said actuator to increase a capacity of said chamber, and a second waveform varying from the second voltage to the first voltage, and the first waveform of each of said ink-non-ejecting signals is approximately the same as the first waveform of each of said ink-ejecting signals.

18. The inkjet recording apparatus as defined in claim 17, wherein said moving device is driven by a dc motor.

19. The inkjet head as defined in claim 15, wherein the third waveform of each of said ink-non-ejecting signals differs from a third waveform of each of said ink-ejecting signals only in a duration time.

20. The inkjet recording apparatus as defined in claim 19, wherein said moving device is driven by a dc motor.

21. The inkjet recording apparatus as defined in claim 15, wherein said controller is operable such that a time interval between said signals is not more than 50 μsec.

22. An inkjet recording apparatus comprising:

(a) an inkjet head including (a-1) a pressure chamber for containing ink, (a-2) a nozzle for communicating through said pressure chamber, (a-3) an actuator operating to change a pressure of said pressure chamber, and (a-4) a controller for driving said actuator by supplying signals including ink-ejecting signals for driving said actuator to eject the ink and ink-non-ejecting signals for driving said actuator not to eject the ink, so as to control ink in said chamber to be ejected from said nozzle at a desirable timing;

(b) a first dc motor for moving a carriage to which said inkjet head is mounted in a main scanning direction; and (c) a second dc motor for moving a recording medium in a sub-scanning direction;

wherein said controller is operable to drive said actuator so that, when the desirable timing for ejecting ink is such that a frequency of said ink-ejecting signals is less than 20 kHz, ink-non-ejecting signals are supplied between ink-ejecting signals to cause an overall frequency of said signals to be not less than 20 kHz.

23. The inkjet recording apparatus as defined in claim 22, wherein said controller is operable such that a time interval between said signals is not more than 50 μsec.

24. The inkjet recording apparatus as defined in claim 22, wherein each of said ink-non-ejecting signals has a first waveform varying from a first voltage to a second voltage and which deforms said actuator to increase a capacity of said pressure chamber, a second waveform varying from the second voltage to the first voltage in a moderate manner and which deforms said actuator to decrease the capacity of said chamber moderately, and a third waveform holding the second voltage between the first and the second waveforms of each of the ink-non-ejecting signals.

25. The inkjet recording apparatus as defined in claim 24, wherein each of said ink-ejecting signals varies between said first voltage and said second voltage.

26. The inkjet recording apparatus as defined in claim 24, wherein said controller is operable such that a time interval between said signals is not more than 50 μsec.

27. An inkjet head comprising:

(a) a pressure chamber for containing ink;

(b) a nozzle for communicating through said pressure chamber;

(c) an actuator operating to change a pressure of said pressure chamber; and (d) a controller for driving said actuator by supplying signals including ink-ejecting signals for driving said actuator to eject the ink and ink-non-ejecting signals for driving said actuator not to eject the ink, so as to control ink in said chamber to be ejected from said nozzle at a desirable timing;

wherein said controller is operable to drive said actuator so that, when the desirable timing for ejecting ink is such that a frequency of said ink-ejecting signals is less than 20 kHz, ink-non-ejecting signals are supplied between ink-ejecting signals to cause an overall frequency of said signals to be not less than 20 kHz.

28. The inkjet head as defined in claim 27, wherein said controller is operable such that a time interval between said signals is not more than 50 μsec.

29. The inkjet head as defined in claim 27, wherein each of said ink-non-ejecting signals has a first waveform varying from a first voltage to a second voltage and which deforms said actuator to increase a capacity of said pressure chamber, a second waveform varying from the second voltage to the first voltage in a moderate manner and which deforms said actuator to decrease the capacity of said chamber moderately, and a third waveform holding the second voltage between the first and the second waveforms of each of the ink-non-ejecting signals.

30. The inkjet head as defined in claim 29, wherein each of said ink-ejecting signals varies between said first voltage and said second voltage.

31. The inkjet recording apparatus as defined in claim 29, wherein said controller is operable such that a time interval between said signals is not more than 50 μsec.

* * * * *